United States Patent [19]

Glass et al.

[11] 3,940,879

[45] Mar. 2, 1976

[54] WALKING DOLL

[76] Inventors: Marvin I. Glass, 815 North LaSalle St.; Allison Katzman, 919 West Fullerton Ave.; Peter Aleksa, 6237 South Talman, all of Chicago, Ill.

[22] Filed: Dec. 14, 1970

[21] Appl. No.: 97,589

[52] U.S. Cl. ..... 46/102

[51] Int. Cl. ..... A63h 11/10

[58] Field of Search ..... 46/102, 115, 116, 118, 46/105, 97, 101, 149, 150, 110, 161

[56] References Cited

UNITED STATES PATENTS

| | | | |
|---|---|---|---|
| 1,597,648 | 8/1926 | Zybach | 46/102 |
| 2,169,380 | 8/1939 | Barrett | 46/161 X |
| 3,267,608 | 8/1966 | Ryan | 46/150 |

FOREIGN PATENTS OR APPLICATIONS

| | | | |
|---|---|---|---|
| 446,331 | 6/1912 | France | 46/97 |

*Primary Examiner*—Louis G. Mancene
*Assistant Examiner*—D. L. Weinhold
*Attorney, Agent, or Firm*—Coffee and Sweeney

[57] ABSTRACT

A walking mechanism for a toy having two legs. Each leg is provided with a vertically elongated slot intermediate its ends which receives a pin connected to a frame mounting a drive motor. The drive motor operates a shaft bearing two eccentrics with the eccentrics being located 180° apart about the shaft and each eccentric is drivingly connected to one end of a respective leg. As a result, each leg is driven through a generally elliptical path with the movement of each being 180° out of phase with the movement of the other.

4 Claims, 10 Drawing Figures

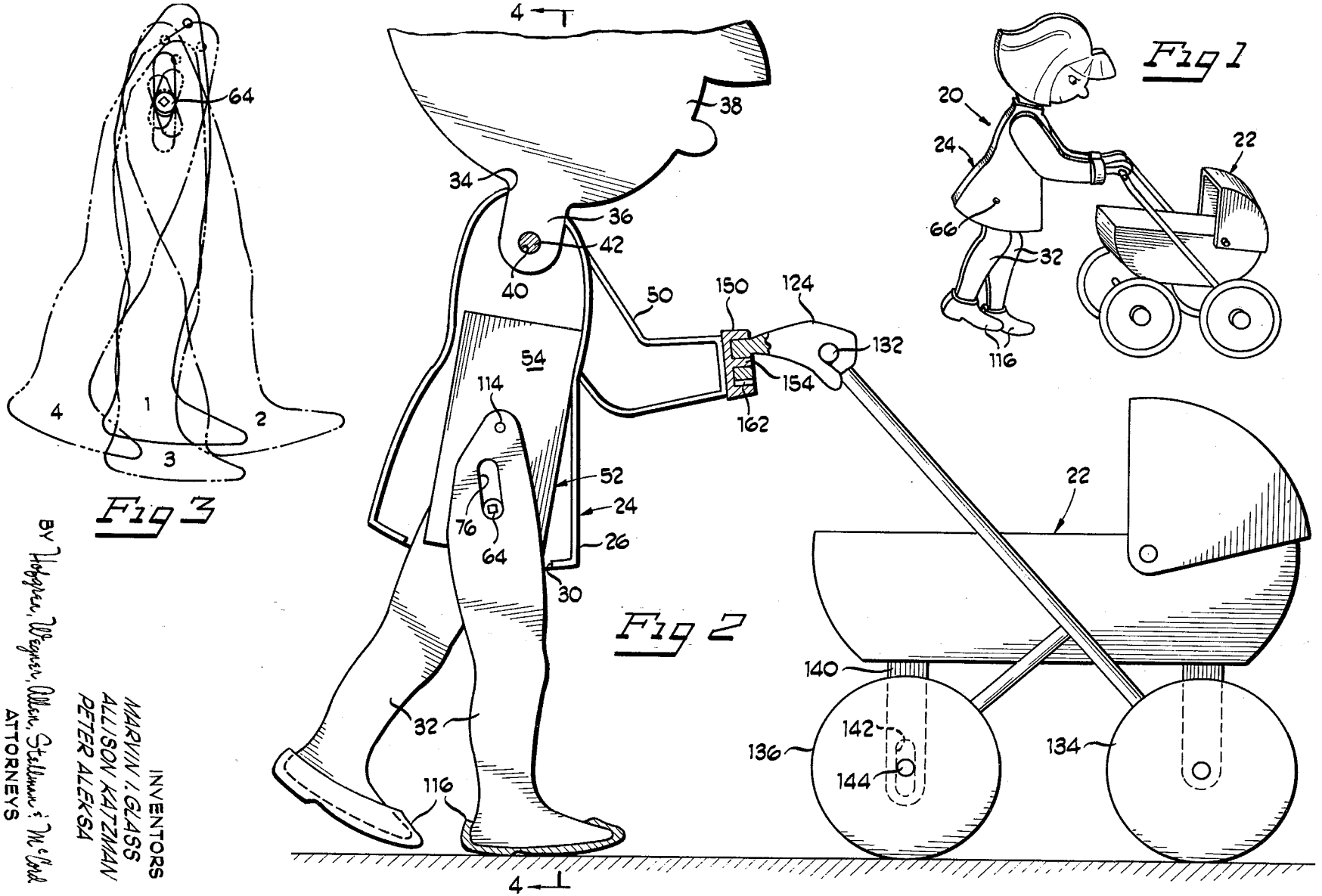
INVENTORS
MARVIN I. GLASS
ALLISON KATZMAN
PETER ALEKSA
BY Hofgren, Wegner, Allen, Stellman & McCord
ATTORNEYS

INVENTORS
MARVIN I. GLASS
ALLISON KATZMAN
PETER ALEKSA

BY Hofgren, Wegner, Allen, Stellman & McCord
ATTORNEYS

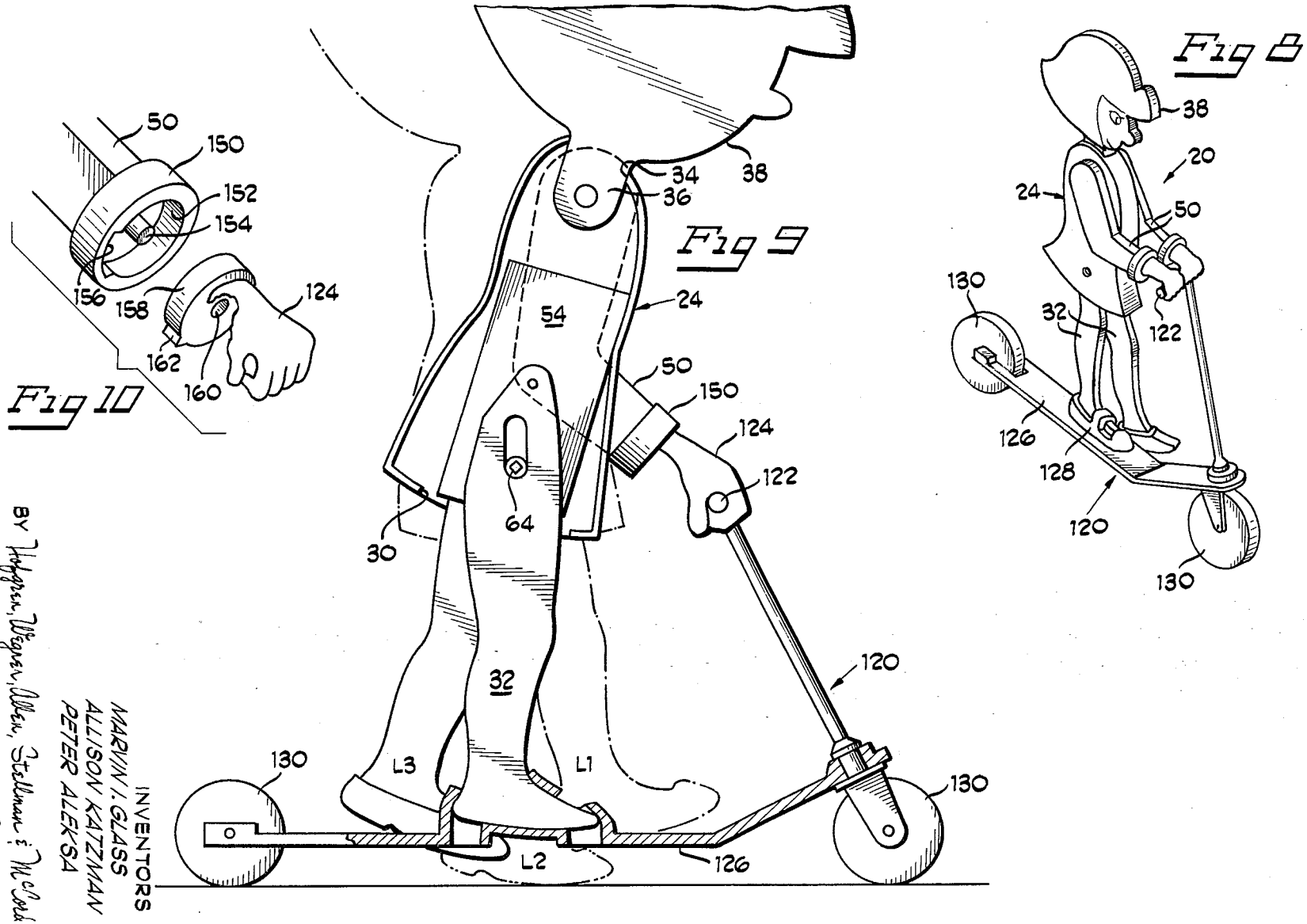
INVENTORS
MARVIN I. GLASS
ALLISON KATZMAN
PETER ALEKSA
BY Hofgren, Wegner, Allen, Stellman & McCord
ATTORNEYS

WALKING DOLL

BACKGROUND OF THE INVENTION

This invention relates to toys, and more specifically, to toys embodying a walking mechanism.

Recent years have seen a great influx of proposals for walking mechanisms for such toy items as dolls, robots, etc. While certain of the proposals have been successfully implemented and have achieved commercial success, because of the compound movement of two legs required by the same, all too often the mechanisms have been extremely complex and therefore relatively expensive to manufacture and embody in a toy.

SUMMARY OF THE INVENTION

The principal object of the invention is to provide a new and improved toy having a walking mechanism. More specifically, it is an object to provide a toy embodying a walking mechanism, which walking mechanism is reliable, drives the legs of the toy in a realistic walking motion and can be manufactured relatively inexpensively.

The exemplary embodiment of the invention achieves the foregoing object by means of a simple drive mechanism including a spring motor driving a rotary output shaft, which shaft mounts on its opposite ends, a pair of eccentrics which are located about the same 180° apart from each other. Each eccentric is drivingly connected to one end of a respective leg and intermediate the end of each leg there is provided an elongated slot which receives a pin affixed to the mechanism frame. Rotation of the shaft by the spring motor will thereby reciprocate and pivot each leg about the pin so that the end of the leg opposite the connection to the eccentric is moved in a generally elongated elliptical path with each leg being moved in its path 180° out of phase with the other leg.

In order to improve the operating characteristics of the spring motor, the same is connected through a reduction gear train to a flywheel which evens out the rate of unloading of the spring motor and regulates the rate of unloading. In order to minimize gear chatter thereby enabling the use of extremely inexpensive gear parts, the flywheel is connected to be driven by the output of the gear train by means of a resilient belt which absorbs energy pulses.

The exemplary embodiment of the invention also contemplates that the toy may be used in conjunction with various accessories. According to one embodiment of the invention, one of the legs may be received in a releasable connection in a miniature scooter configured so that the other leg may contact a supporting surface as it moves through a portion of its path of movement to thereby propel the scooter with the toy on the same. According to another embodiment of the invention, the toy by means of miniature hands may be releasably connected to a handle on a vehicle such as a baby buggy to push the same. In order to insure that the wheels of the buggy are maintained in contact with the supporting surface during up and down motion of the toy during walking of the same, the rear set of wheels of the same are mounted for vertical movement relative to the vehicle frame as the latter is moved up and down by the toy.

To facilitate the use of the toy with still other accessories, a unique connection between the hands of the same and the arm which permits limited pivotal movement is provided so that the hands may grip another instrumentality that extends generally horizontally, generally vertically or at various intermediate attitudes.

Other objects, and advantages of the invention will become apparent from the following specification taken in conjunction with the accompanying drawings.

DESCRIPTION OF DRAWINGS

FIG. 1 is a perspective view of a toy embodying the invention;

FIG. 2 is an enlarged, side elevation of the toy with parts shown in section;

FIG. 3 is a schematic illustrating four sequential positions of leg-like appendage through one cycle of operation of the invention;

FIG. 8 is a perspective view of a toy embodying the invention and including an exemplary vehicle;

FIG. 9 is a vertical section of the toy and auxiliary vehicle shown in FIG. 8; and FIG. 10 is an exploded view of a connection between a hand and arm for the toy illustrated in various of the other figures.

DESCRIPTION OF THE PREFERRED EMBODIMENTS

An exemplary embodiment of a walking toy made according to the invention is illustrated in FIG. 1 in perspective and is seen to include a doll body in the figure of a young girl, generally designated 20. As illustrated in FIG. 1, the doll 20 is pushing a toy baby buggy, generally designated 22, which will be described in greater detail hereinafter.

Figure 4:
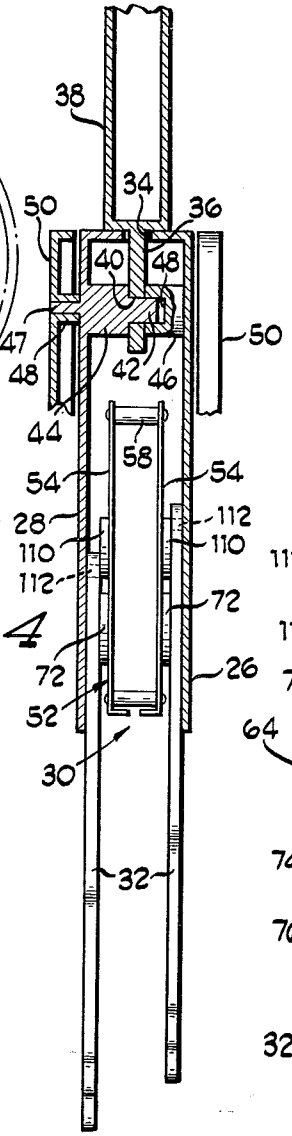
FIG. 4 is a vertical section taken approximately along the line 4—4 of FIG. 2.

With reference to FIGS. 2 and 4, the doll 20 is comprised of a housing 24 configured in the form of a dress and formed of two shell halves 26 and 28. The shell halves 26 and 28 may be secured together in any suitable manner and are configured to define a lower opening, generally designated 30, through which a pair of legs 32 downwardly extend. The housing 24 further includes an upper opening 34 for receiving a downwardly extending projection 36 of a doll head 38. The projection 36 includes an aperture 40 receiving a stub shaft 42 extending from a boss 44 on the inner side of the shell half 28. The shell half 26 includes an inwardly extending boss 46 having a recess 48 aligned with and receiving the end of the stub shaft 42 whereby the head 38 is mounted for limited pivotal movement.

On the outer side of each of the shell halves 26 and 28 near the upper extremity thereof there is provided an outwardly extending stub shaft 47 which is received in a collar 48 integrally formed with an arm 50. The arm 50 may be secured to the stub shaft 47 in any suitable manner. For example, if the elements are formed of resilient material, suitable snap fitting means may be employed so long as the same permit pivotal movement of the arm 50 on the stub shaft 47.

The basic assemblage is completed by a drive motor and motion imparting mechanism, generally designated 52, located within the housing 24 and interposed between the legs 32 to impart a walking motion thereto.

Figure 6:
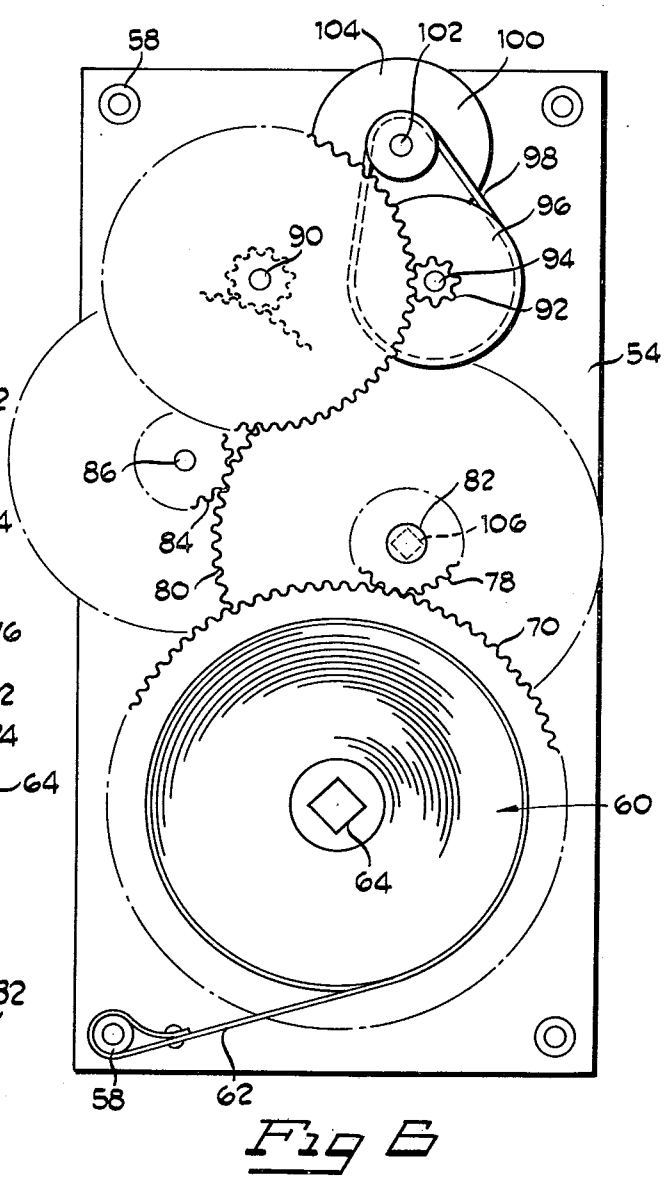
FIG. 6 is a side elevation of the partially assembled mechanism shown in FIG. 5.
Figure 5:
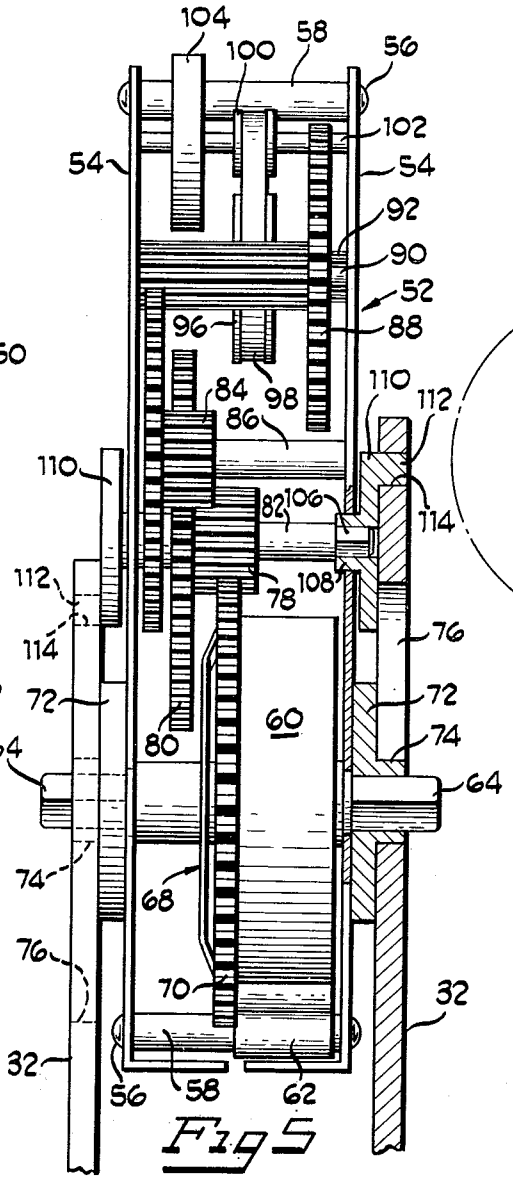
FIG. 5 is an enlarged, fragmentary vertical section of a portion of the mechanism illustrated in FIG. 4.

With reference to FIGS. 2, 5 and 6, the mechanism 52 is seen to comprise a pair of spaced mounting plates 54 which are secured together by means of rivets 56 and spacing sleeves 58. Near the lower extremity of the structure defined by the plates 54 and between the two there is located a conventional spring motor, generally designated 60. The spring motor 60 includes, as is well known, a spring 62 and one end of the same may be secured against movement to one of the spacing sleeves 58. The other end of the spring 62 is secured, either directly or indirectly, to a keyed shaft 64 which may receive a winding key (not shown) for the purpose of winding up the spring motor 60. The housing 24, on one or the other or both sides thereof includes an opening 66 (FIG. 1) for insertion of such a winding key.

Figure 7:
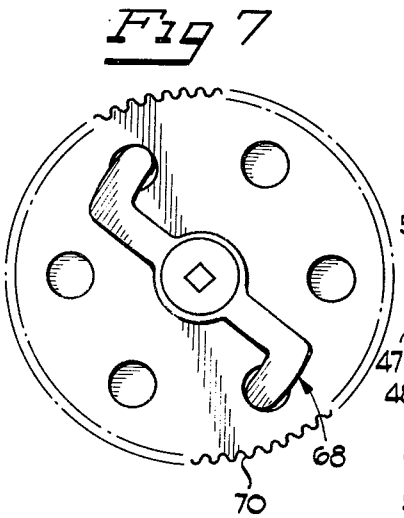
FIG. 7 is a side elevation of a portion of a drive mechanism.

As illustrated in FIG. 7, the spring motor 60 is completed by a conventional ratchet mechanism, generally designated 68 for maintaining the spring 62 in a wound state whereby the energy stored therein will be imparted in the form of rotary motion to an associated spur gear 70.

Returning to FIG. 5, the ends of the shaft 64 at their point of emergence through the plates 54 are surrounded by bearing plates 72 through which the shaft 64 extends. Each of the bearing plates 72 includes an outwardly extending pin formation 74 which is received in an elongated slot 76 in a corresponding one of the legs 32 to define therewith a pin and slot connection. The pin and slot connection thus defined is intermediate the end of the respective legs 32.

The spur gear 70 is in mesh with a small spur gear 78 which in turn is drivingly connected to an enlarged spur gear 80. The spur gears 78 and 80 are mounted for rotation on a shaft 82 and pinned thereto to impart rotation of the same. As will be seen, the shaft 82 serves as the output shaft to drive the legs 32 in a walking motion.

The gear 80 is in engagement with a reduction gear combination 84 mounted for rotation on a shaft 86 which in turn drives a reduction gear combination 88 mounted for rotation on a shaft 90. The large gear of the combination 88 in turn drives a small spur gear 92 (FIG. 6) which is drivingly connected to a rotatably mounted shaft 94 which also mounts an enlarged sheave 96. A belt 98 formed of a resilient material such as rubber is trained about the sheave 96 and is in driving engagement with a small sheave 100 which is pinned to a rotary shaft 102. Also pinned to the rotary shaft 102 for rotation therewith is a flywheel 104 which serves to regulate the rate at which the spring motor 70 unwinds as well as to smooth out the unwinding action. The resilient belt 98 is operative to absorb pulses in energy and serves thereby to minimize the noise of operation by eliminating chatter amongst the various gears.

Returning to the output shaft 82, the same is seen to include squared ends 106 received in hubs 108 of bearing discs 110 having crank arms 112 near one extremity thereof. The hubs 108 are journalled in apertures in respective ones of the plates 54.

Each of the legs 32 includes a bore 114 in its upper extremity which receives a respective crank 112 to establish a driving connection. As illustrated in FIG. 5, the crank 112 associated with the rightmost leg 32 is oriented with respect to the shaft 82 so as to be 180° away from the location of the crank 112 associated with the left-most leg 32.

Turning now to FIG. 3, the nature of operation of one of the legs 32 will become apparent. In FIG. 3, there are four dotted line showings of leg 32 and assuming that the leg corresponds to the rightmost leg 32 in FIG. 5 and starts at the position therein shown, the leg 32 will be in the position identified as position number 1. This will be due to the fact that the crank 112 is at its uppermost position so the leg is centered at its uppermost position with the pin 74 being in the lowermost end of the slot 76. As the crank 112 is rotated 90° in a counterclockwise direction with regard to the showing in FIG. 3, the upper end of the same will pivot to the left about the pin 74 and will be moved downwardly resulting in the leg being moved to the position identified as position number 2. Continued movement of the crank will result in the same reaching its lowermost position to further lower the leg. Furthermore, the second 90° of rotation of the crank will result in the leg moving rearwardly and the net result will be that after 180° of rotation of the crank 112, the leg will be in the position identified as position number 3. Continued rotation of the crank will result in the leg being moved rearwardly and upwardly for the next 90° of rotation to the position identified as position number 4. Continued rotation through another 90° will result in the leg being returned to position number 1.

It will be recalled that the orientation of the two cranks 112 for the respective legs 32 is 180° out of phase on the shaft 82. As a result, when the rightmost leg is in position number 1, the left leg will be in position number 3. As the right leg moves to position number 2, the left will move to position number 4, etc. As a result, the two legs have a walking motion imparted thereto.

Returning now to FIG. 2, to insure that the walking motion imparted to the legs 32 will result in movement of the doll, the lower extremity of each of the legs 32 may be provided with an ornamental slipper such as those illustrated at 116. Preferably, such slippers are made out of a material that will have a high coefficient of friction with the surface on which the doll is to be used.

Turning now to FIGS. 8 and 9, a doll embodying the walking mechanism just described may be used in conjunction with an auxiliary toy vehicle such as a scooter, generally designated 120. The toy scooter 120 may be formed as a miniature scooter by any suitable manner and includes a handle grip 122 to which hands 124 of the doll may be releasably secured in any suitable manner known in the art. The platform 126 of the scooter is further provided with a releasable connector 128 which may be much of the form of the slippers 116 for receiving the foot of one of the legs 32. The overall construction of the releasable connector 128, the platform 126 and wheels 130 of the scooter 120 is such that the other leg 32 may be in contact with the supporting surface for at least some portion of its movement. As a result the doll can actually ride and propel the miniature scooter 120 as the free leg 32 moves through positions L1, L2 and L3 shown in dotted lines in FIG. 9.

Returning to FIG. 2, a specific feature of the baby buggy 22 will be described. From the foregoing, it will be appreciated that as the doll walks, the body 20 of the same will reciprocate in a generally vertical direction. When the hands 124 of the doll are secured to a handle 132 on the baby buggy 22, the vertically reciprocating action of the doll will result in the handle 132 being moved upwardly and downwardly as the doll walks. Since the baby buggy 22 will conventionally include front wheels 134, the same will serve as a pivot point for the entire buggy 22 and in order to insure that the rear wheels 136 of the same are maintained in contact with the supporting surface for realism, a frame member 140 of the buggy 22 mounting the rear wheels 136 is provided with an elongated slot 142 for receiving the axle 144 mounting the rear wheels 136. As a result, the axis of the rotation of the wheels 136 can move relatively to the body of the buggy 22 as the same is pivoted back and forth about the pivot provided by the wheel 134 to maintain contact with the supporting surface.

While the doll herein described has been illustrated in conjunction with vehicles of a type having generally horizontal handle grips, such as the grips 122 and 132, it will be appreciated that the same may find use with other types of accessories, as, for example, skiis. In such a case, to add realism to the toy, it is desirable to employ ski poles, not shown, which, of course, would be gripped by the hands 124 at an attitude approximately 90° from that with which the grips 122 and 132 are gripped. To this end, the extremity of each arm 50 is provided with a cuff formation 150 as best seen in FIGS. 2 and 10. The cuff formation 150 includes a circular recess 152 having a centered, outwardly projecting stub shaft 154 and a peripheral notch 156 having a radial extent of about 90°. The hand 124 is mounted on a disc 158 having a central aperture 160 for snap fit receipt of the stub shaft 154 and a peripherally extending tooth 162 for receipt in the slot 156. As a result, each hand 124 is mounted for rotation through about 90° on its respective arm 50 so that the hand may be moved to grip other accessories in a realistic manner.

We claim:

1. A walking mechanism for a toy comprising: first and second legs, each having first and second opposite ends with a surface engaging portion at the first end thereof, a driving portion at the second end thereof and a portion of a pin and slot connection on each leg near the second end and intermediate the first end and the driving portion; a drive mechanism for said legs including a spring motor, a rotary shaft driven by the spring motor and terminating at each end in cranks, said cranks being oriented on said shaft in an out of phase relation with each other and each being connected to the driving portion of a respective one of said legs against lost motion relative to the legs; mounting means, means on said mounting means defining the other portion of said pin and slot connections, said other portions being in mating relation with a respective one of said first portions of said pin and slot connections on said legs whereby each leg will be positively driven by each crank and pivot about the pin and slot connection so that the first end of each leg will move in a walk simulating elongated eliptical path of travel.

2. The walking mechanism of claim 1 further including a rotary flywheel, and transmission means operatively interposed between said spring motor and said flywheel, said transmission means including a gear train and a driving connection having a resilient belt whereby gear noise during operation of the spring motor is minimized.

3. The walking mechanism of claim 1 wherein said resilient belt drivingly interconnects said gear train and said rotary flywheel.

4. A walking toy embodying the walking mechanism of claim 1 further including means defining a toy figure receiving said walking mechanism, said toy figure including a pair of arms, a pair of hands, one for each arm; and means interconnecting each hand to a respective arm for a limited pivotal movement.

* * * * *